US006981996B2

(12) United States Patent
Shaner et al.

(10) Patent No.: US 6,981,996 B2
(45) Date of Patent: Jan. 3, 2006

(54) TUNGSTEN-TIN COMPOSITE MATERIAL FOR GREEN AMMUNITION

(75) Inventors: Kenneth H. Shaner, Towanda, PA (US); Michael R. Pierce, Towanda, PA (US)

(73) Assignee: Osram Sylvania Inc., Danvers, MA (US)

( * ) Notice: Subject to any disclaimer, the term of this patent is extended or adjusted under 35 U.S.C. 154(b) by 0 days.

(21) Appl. No.: 10/389,321

(22) Filed: Mar. 14, 2003

(65) Prior Publication Data

US 2004/0177720 A1 Sep. 16, 2004

(51) Int. Cl.
*B22F 3/00* (2006.01)

(52) U.S. Cl. ..... 75/248; 419/66

(58) Field of Classification Search ..... 75/248; 419/66

See application file for complete search history.

(56) References Cited

U.S. PATENT DOCUMENTS

| | | | | |
|---|---|---|---|---|
| 4,783,218 | A * | 11/1988 | Kemp et al. | 75/342 |
| 5,279,787 | A | 1/1994 | Oltrogge | 419/38 |
| 5,760,331 | A | 6/1998 | Lowden et al. | 102/506 |
| 5,847,313 | A | 12/1998 | Beal | 102/516 |
| 5,877,437 | A | 3/1999 | Oltrogge | 75/228 |
| 5,963,776 | A | 10/1999 | Lowden et al. | 419/64 |
| 6,048,379 | A * | 4/2000 | Bray et al. | 75/229 |
| 6,149,705 | A | 11/2000 | Lowden et al. | 75/240 |
| 6,457,417 | B1 * | 10/2002 | Beal | 102/517 |
| 6,551,376 | B1 * | 4/2003 | Beal | 75/252 |
| 6,569,381 | B2 * | 5/2003 | Le Floc'h et al. | 419/67 |
| 6,607,692 | B2 * | 8/2003 | Beal | 419/65 |
| 2003/0027005 | A1 * | 2/2003 | Elliott | 428/457 |
| 2003/0164063 | A1 | 9/2003 | Elliott | 75/252 |

* cited by examiner

*Primary Examiner*—Ngoclan T. Mai
(74) *Attorney, Agent, or Firm*—Robert F. Clark

(57) ABSTRACT

A tungsten-tin composite for green (lead-free) ammunition is provided wherein the composite is made with a spheroidized tungsten powder and has mechanical properties similar to those of lead. The composite may be fully densified at pressures less than about 250 MPa and is suitable for pressing complex projectile shapes to near net size.

21 Claims, 6 Drawing Sheets

TUNGSTEN-TIN COMPOSITE MATERIAL FOR GREEN AMMUNITION

TECHNICAL FIELD

The present invention relates to lead-free compositions for environmentally safe ("green") ammunition. More particularly, the invention relates to tungsten-tin composites for replacing lead in projectiles such as bullets.

BACKGROUND OF THE INVENTION

The environmental and health risks associated with lead have resulted in a comprehensive campaign to eliminate its use in many applications including lead-containing ammunition. In particular, government regulations are forcing a change to lead-free rounds in small arms ammunition because of growing lead contamination problems at firing ranges. Toxic lead-containing dust created by fired rounds poses an air-borne health risk and lead leaching from years worth of accumulated spent rounds is now posing a substantial hazard to local water supplies.

Over the years, a number of composite materials have been proposed as lead substitutes. The methods of making these composites generally involve blending a powdered material having a density greater than that of lead with a powdered binder material having a density less than that of lead. The blended powders are then pressed, injection molded, or extruded to form slugs of the composite material. In order to have acceptable and consistent ballistic properties, the composite material formed after pressing should be void-free (i.e., have a measured density which is about 100% of the theoretical density) and without macroscopic segregation of the components. Also, it is preferred that the composite material should have a density and mechanical properties similar to those of lead so that the composite material may be used as a drop-in replacement for lead-containing ammunition in a wide range of applications.

Most importantly, the composite material should be sufficiently malleable and ductile so that the slugs of the composite material will deform uniformly and allow the composite material to be pressed directly into pointed bullet shapes or to fill the cores of jacketed projectiles.

In order to achieve a density similar to lead, tungsten which has a density of 19.3 g/cm$^3$ has been combined with binder materials such as nylon and tin to make lead-free projectiles. However, the composites made by these methods are either too expensive to manufacture or do not possess one or more of the desired properties, i.e., ductility, malleability, density, etc.

More particularly, tungsten-nylon composites are 50% more expensive than lead because of the high tungsten content needed to achieve a lead-like density. And, even at the highest tungsten content possible for these composites, about 96 wt. % W, the density of a tungsten-nylon composite is 10.8 g/cm$^3$ or only about 95% that of lead.

Although less expensive than tungsten-nylon, tungsten-tin composites have experienced greater problems with achieving lead-like properties. For example, U.S. Pat. No. 5,760,311 to Lowden et al. describes a tungsten-tin (W—Sn) composite made by blending large tungsten particulates (149 $\mu$m or greater) with a tin powder in either a 58/42 or 70/30 weight ratio of tungsten to tin. The blended powder was compressed at pressures ranging from 140 to 350 MPa to form slugs having densities ranging from 9.76 to 11.49 g/cm$^3$. The compressive strengths of the slugs ranged from 70 to 137 MPa which is significantly higher than that of lead (about 20 MPa). This means that the slugs would not have sufficient malleability to be pressed directly into bullet shapes or uniformly deform to fill the core of a jacketed projectile. Moreover, the slugs could only be pressed to between about 89% (70/30 blend) to 92% (58/42 blend) of theoretical density meaning that the slugs contained a significant quantity of void space. The existence of a significant quantity of voids in the material may result in an inhomogeneous density in the projectile which can affect its ballistic performance and, in particular, its accuracy. Furthermore, the highest densities could be achieved only by pressing the blends at pressures of 280 Mpa or greater.

SUMMARY OF THE INVENTION

It is an object of the invention to obviate the disadvantages of the prior art.

It is a another object of the invention to provide a tungsten-tin composite having mechanical properties similar to those of lead.

It is a further object of the invention to provide a tungsten-tin composite which can be fully densified at lower pressing pressures.

In accordance with one aspect the invention, there is provided a tungsten-tin composite material for lead-free ammunition comprising spheroidized tungsten particles imbedded in a tin matrix, the composite material having a measured density which is at least 99% of the theoretical density of the composite.

In accordance with another aspect of the invention, there is provided a tungsten-tin composite which can be fully densified at pressures less than about 250 MPa.

DETAILED DESCRIPTION OF THE INVENTION

For a better understanding of the present invention, together with other and further objects, advantages and capabilities thereof, reference is made to the following disclosure and appended claims taken in conjunction with the above-described drawings.

Figure 1:
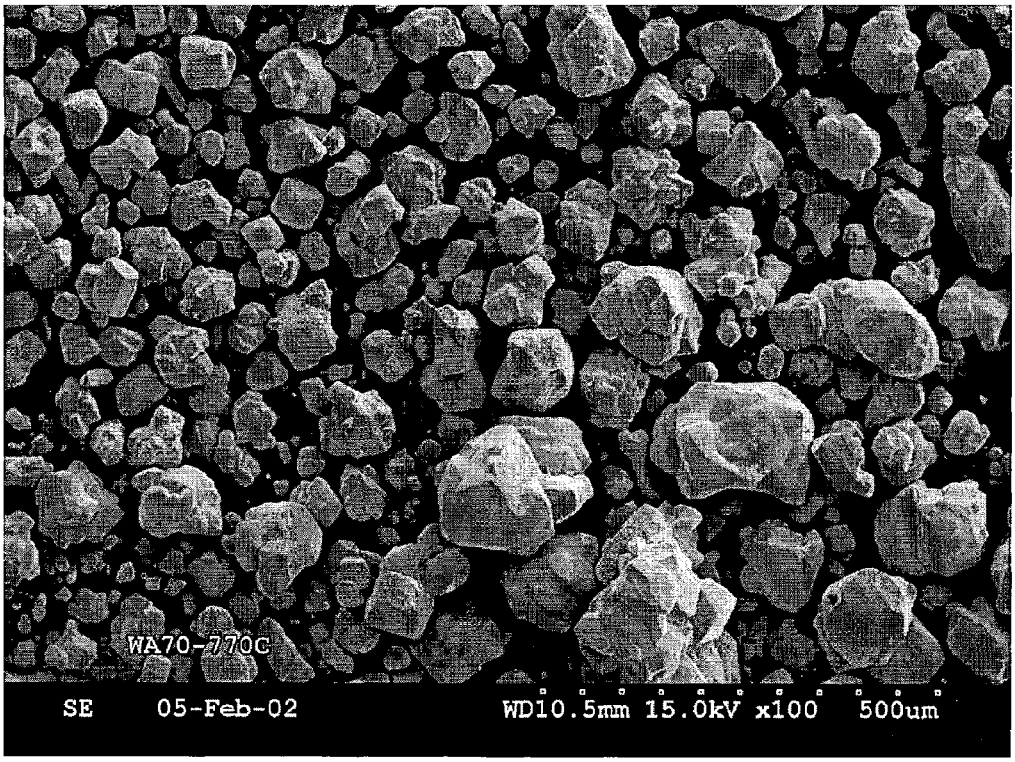
Fig. 1 (Prior Art)
FIG. 1 is a scanning electron photomicrograph of a prior art as-reduced tungsten powder.

The tungsten powder used generally in prior art methods for making lead-free ammunition is an as-reduced powder which consists of irregularly shaped tungsten particles as shown in FIG. 1. A typical as-reduced tungsten powder is Type M70 manufactured by OSRAM SYLVANIA Inc. of Towanda, Pa. Higher pressures, greater than about 275 MPa, are required to make fully densified parts using as-reduced powders because of the interaction between the particles. Bridging between the irregular particles occurs during compaction so more pressure is required to break down the bridging and force tin into the voids. The high pressing pressures and the low flowability of the as-reduced powders makes it is difficult to directly form complex projectile shapes and jacketed rounds. As used herein, full densification means that the measured densities are at least 99%, and more preferably at least 99.5%, of the theoretical density.

Figure 2:
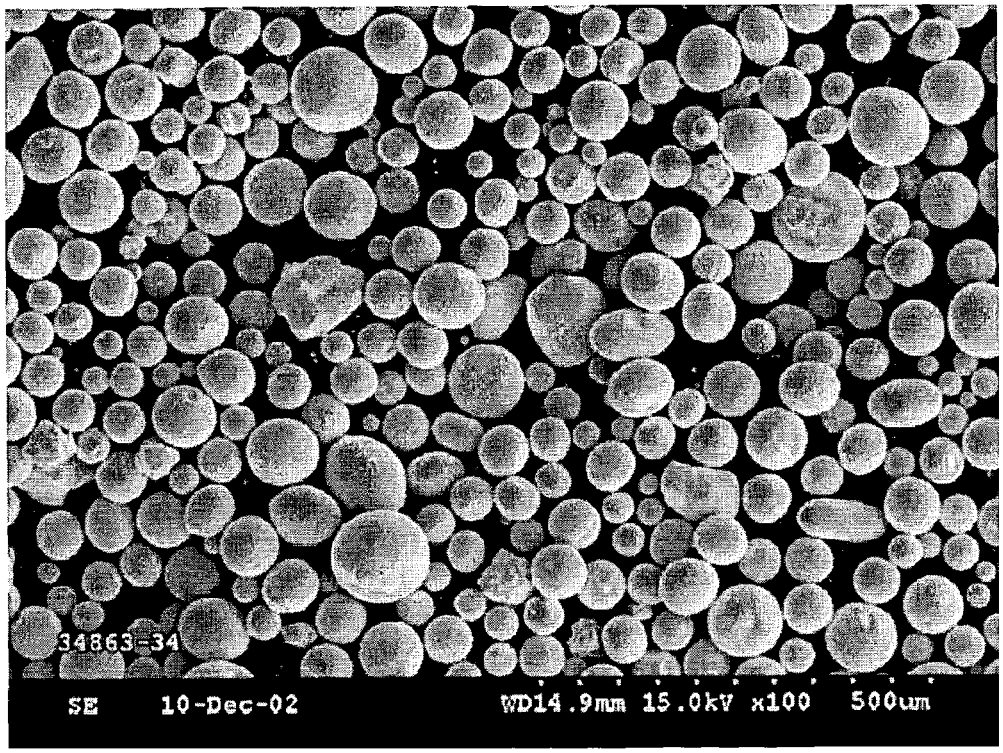
FIG. 2 is a scanning electron photomicrograph of a spheroidized tungsten powder used in this invention.

The tungsten-tin composite material of the present invention uses a spheroidized tungsten powder. As shown in FIG. 2, the spheroidized tungsten powder is comprised of tungsten particles having a spherical or nearly spherical shape. Preferably, the tungsten particles have a mean particle size of less than 100 $\mu$m. More preferably, the particles have a mean particle size of 50 $\mu$m. (MICROTRAC M100 Particle Size Analyzer) The spheroidized powder is made by entraining the irregular particles of an as-reduced tungsten powder in an inert gas stream and passing the particles at high velocity through a high temperature plasma gun. The irregular particles at least partially melt as they pass through the plasma gun to form molten droplets. These droplets are rapidly cooled as they exit the plasma gun resulting in substantially spherical tungsten particles. A preferred spheroidized tungsten powder for use in the W—Sn composite material of this invention has a relatively narrow distribution of particle sizes. In particular, it is preferred that the particle size distribution have a standard deviation of no more than about 20 $\mu$m in particle size. A composition of 57 weight percent (wt. %) tungsten and 43 weight percent tin, i.e., 57/43 W—Sn, is preferred in order to achieve a density close to the density of lead (11.34 g/cm$^3$) when the composite if fully densified. The theoretical density for a 57/43 W—Sn composite is 11.32 g/cm$^3$.

The use of a spheroidized tungsten powder in making the W—Sn composite improves the flowability of the powder mixture and reduces particle-to-particle interactions during compaction thereby improving densification. This makes it possible to achieve fully densified parts at much lower pressing pressures. For example, the pressure required to make a fully dense symmetrical shape like a right circular cylinder ranges from about 275 MPa to about 400 MPa for a tungsten-tin powder blend containing the standard as-reduced tungsten powder. The same shape can be pressed to full density at pressures less than about 250 MPa, and more preferably less than about 210 MPa, when a spheroidized tungsten powder is used. The improved pressability makes it possible to press more complex shapes like bullets to near net shape thereby reducing manufacturing costs.

Figure 3:
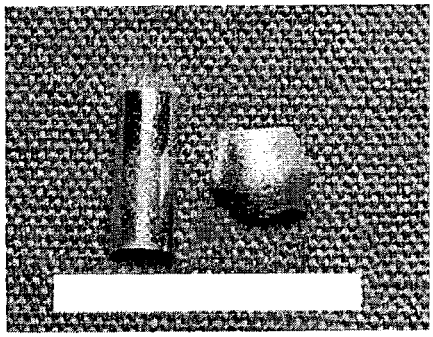
FIG. 3 is a photograph of a right circular cylinder made from the tungsten-tin composite material of this invention before and after the application of a compressive force.

In addition to achieving full densification at low pressures, the tungsten-tin composite material of this invention deforms uniformly and has a low compressive strength, preferably less than 50 MPa. This is important when pressing parts to near net shape and is especially desirable for making jacketed munitions where the W—Sn composite must flow to fill the voids in the core of the projectile. FIG. 3 demonstrates the substantially uniform deformation of a right circular cylinder formed from a 57/43 tungsten-tin composite of this invention. The cylinder is shown before and after the application of a compressive force. As compressive force was applied, the cylinder bulged radially outward near its midpoint in a substantially uniform manner. Unlike the present invention, uniform deformation is not typical for W—Sn composites made with prior art as-reduced tungsten powders. For example, when a similar test was conducted on a 57/43 W—Sn composite containing an as-reduced W powder, the cylinder because of its lower ductility began to fracture and slip to one side as the compressive force was applied.

Figure 4A:
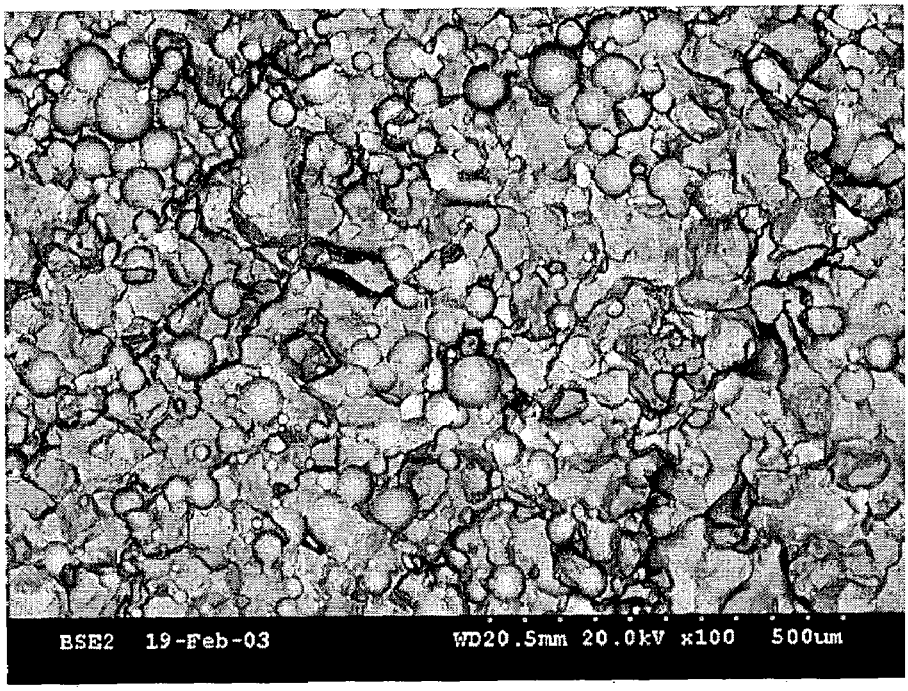
FIG. 4A is a scanning electron photomicrograph showing the microstructure of the tungsten-tin composite of this invention.
Figure 4B:
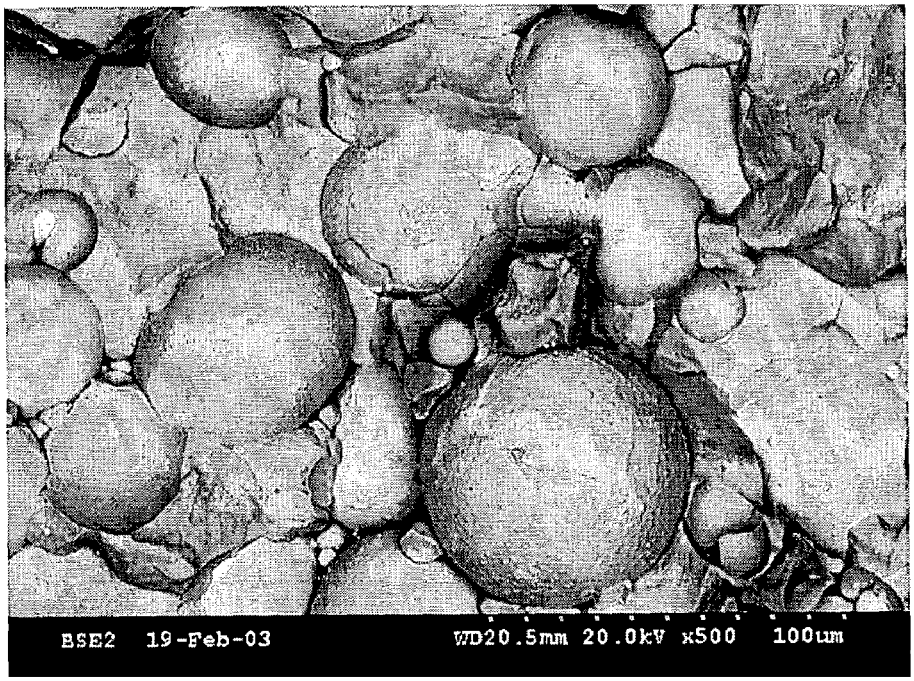
FIG. 4B is a higher magnification of the microstructure shown in FIG. 4A.
Figure 5A:
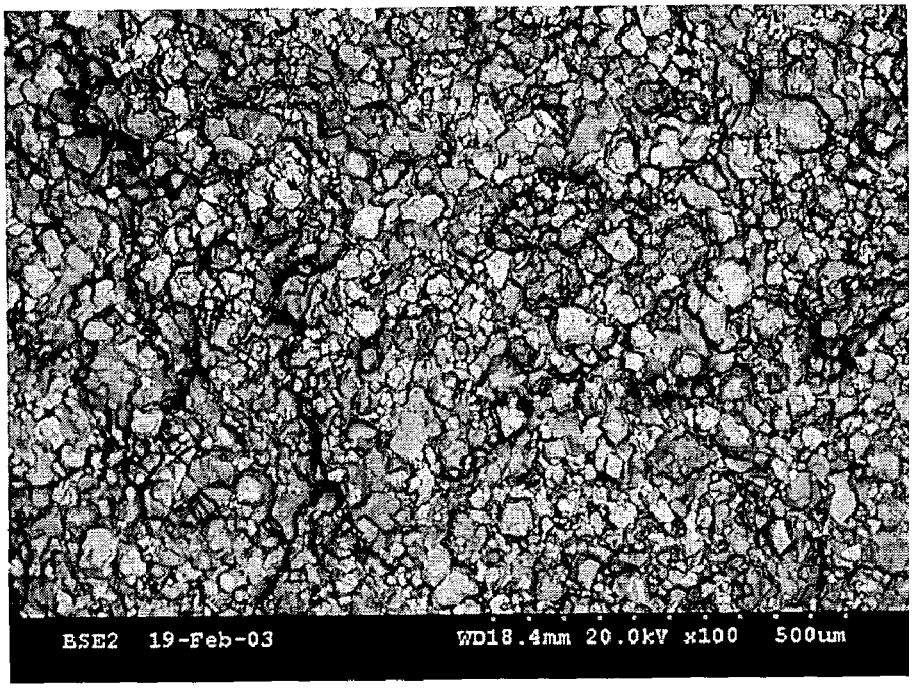
FIG. 5A is a scanning electron photomicrograph showing the microstructure of a tungsten-tin composite made with a prior art as-reduced tungsten powder.
Figure 5B:
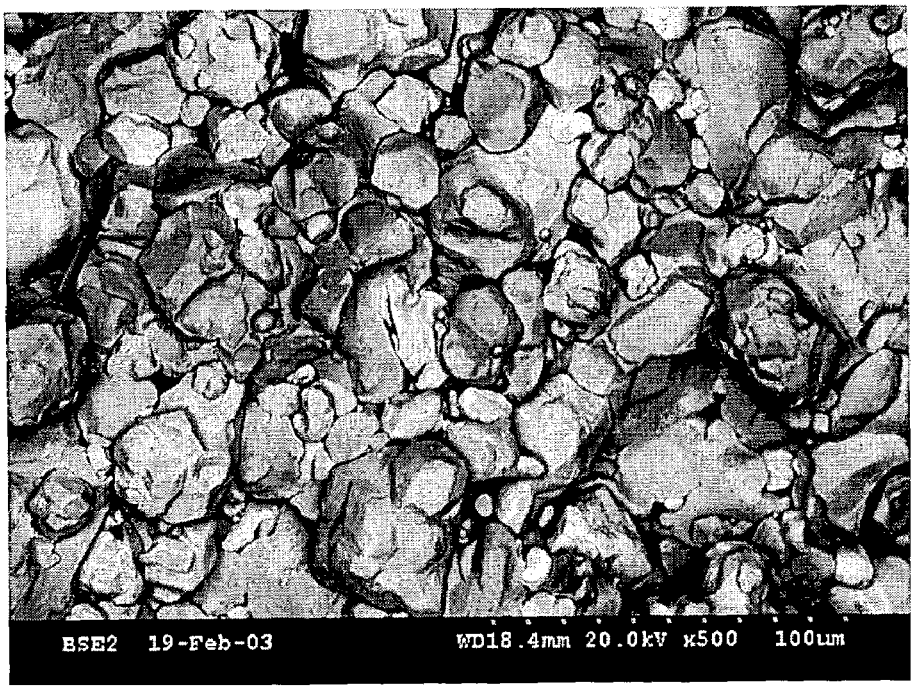
FIG. 5B is a higher magnification of the microstructure shown in FIG. 5A.

FIGS. 4A–B and 5A–B are scanning electron photomicrographs of the microstructure of two fractured tungsten-tin composites. In FIGS. 4A and 4B, the microstructure of a 57/43 tungsten-tin composite of this invention is shown. The spheroidized tungsten particles are clearly evident in the tin matrix. More importantly, the photomicrographs show that the spheroidized tungsten particles have retained their shape even after pressing. It is believed that this is a major reason why the W—Sn composite of this invention possesses mechanical properties closer to those of lead. This is to be contrasted with FIGS. 5A and 5B which show the microstructure of a 57/43 tungsten-tin composite made with an irregular as-reduced tungsten powder. The irregular tungsten particles in the composite result in significant particle-to-particle interactions when the composite is compressed. This is believed to cause a non-uniform distribution of stress within the composite which is likely the reason why the composite fractures rather than deforming uniformly.

Another important advantage of the W—Sn composite of this invention are the significantly lower pressures needed for upsetting parts. In particular, parts having complex shapes need to be manufactured without the parting lines that are typically present with conventional PM powder consolidation. This requires upsetting the part from a preformed pill or a powder blend. When an as-reduced W powder is used, a pressure in excess of 675 MPa is required for upsetting a part with a preformed pill. This pressure drops to 550 MPa when using a preformed pill made from the W—Sn composite of this invention. Similarly, upsetting parts with powder blends made from as-reduced W powders require pressures on the order of 900 MPa. The necessary pressures are reduced to around 650 MPa for powder blends made with spheroidized tungsten powders. Because of the lower forming pressures, less tool wear is expected.

Figure 6A:
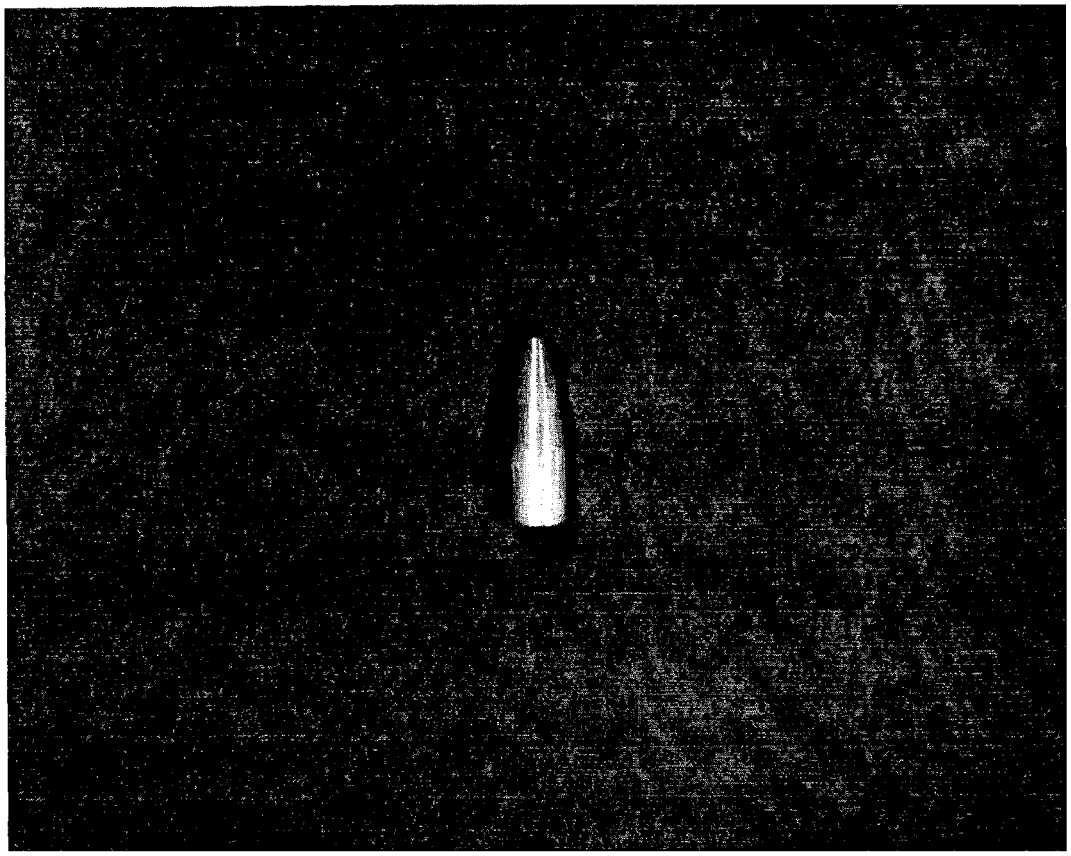
FIG. 6A is a photograph of a 7.62 mm round.
Figure 6B:
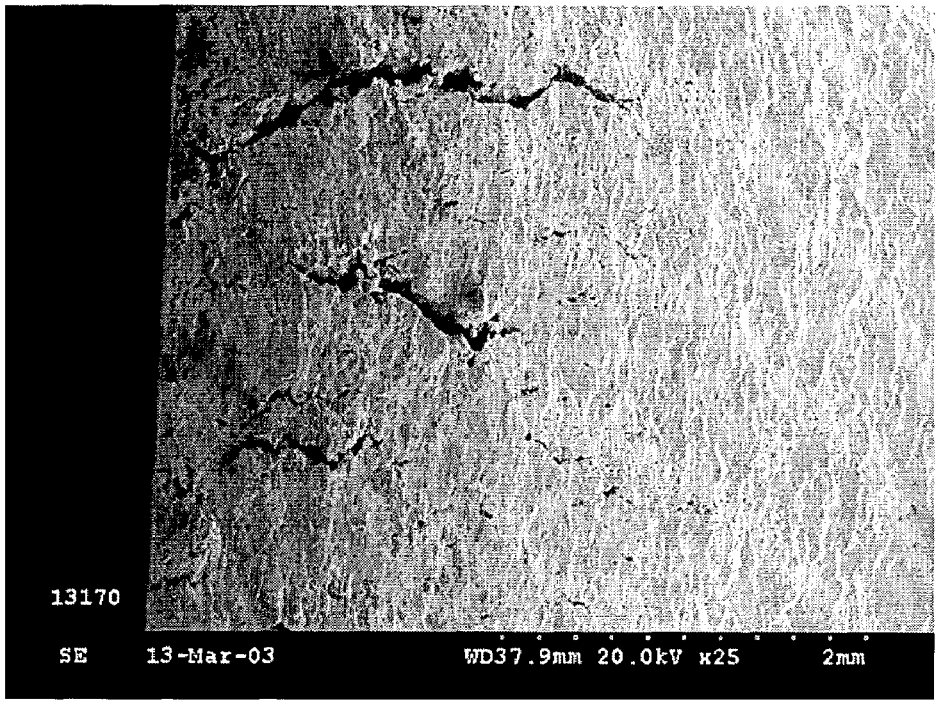
FIG. 6B is a magnified view of a crushed tip of a 7.62 mm round made with an as-reduced tungsten powder.
Figure 6C:
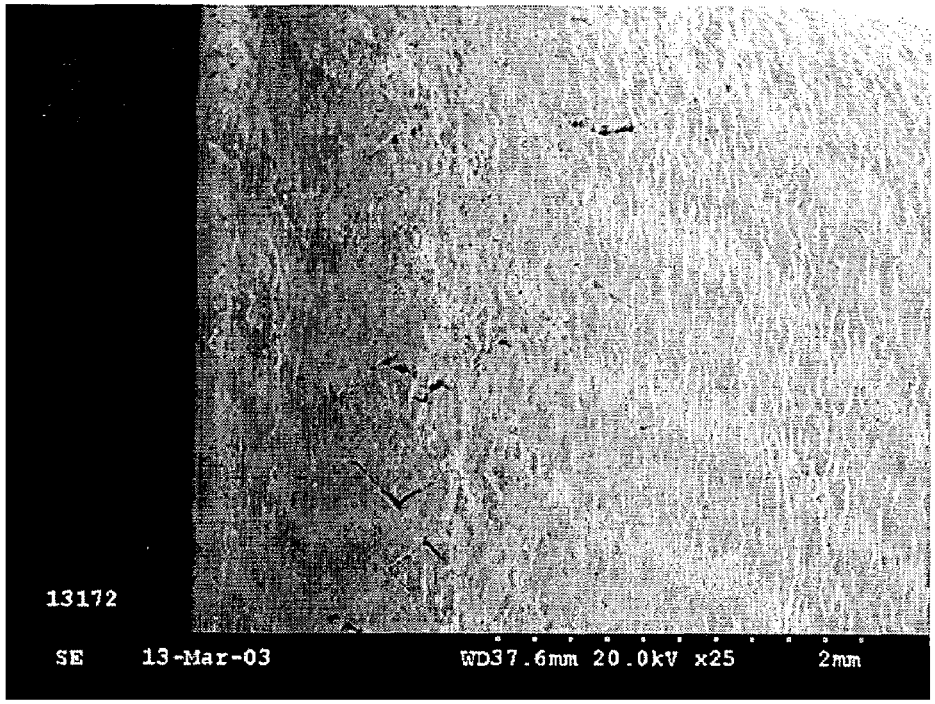
FIG. 6C is a magnified view of a crushed tip of a 7.62 mm round made with the W—Sn composite of this invention.

FIGS. 6A–C demonstrate the lower upsetting pressure for the W—Sn composite of this invention. Two 7.62 mm rounds were made by pressing preformed pills of a 57/43 W—Sn composite at 670 MPa. An example of a 7.62 mm round is shown in FIG. 6A. One round was made from a W—Sn composite containing a spheroidized W powder according to this invention. The other round was made from a composite containing an as-reduced W powder. Both rounds were subjected to a crush test in which the rounds were compressed to the same height by applying a compressive force to the tips.

FIG. 6B is a magnified view of the crushed tip of the 7.62 mm round made with the as-reduced W powder. FIG. 6C is a magnified view of the crushed tip of the 7.62 mm round made with the W—Sn composite of this invention. Numerous large cracks are visible in the crushed tip of the round made with the as-reduced powder whereas only a few minor cracks appear in the crushed tip of the round made with the W—Sn composite of this invention. This demonstrates that a higher ductility and malleability can achieved at lower upsetting pressures using the W—Sn composite of this invention.

While there has been shown and described what are at the present considered the preferred embodiments of the invention, it will be obvious to those skilled in the art that various changes and modifications may be made therein without departing from the scope of the invention as defined by the appended claims.

We claim:

1. A tungsten-tin composite material for lead-free ammunition comprising spheroidized tungsten particles imbedded in a tin matrix, the composite material having a measured density which is at least 99% of the theoretical density of the composite.

2. The composite material of claim 1 wherein the tungsten particles have a mean particle size of less than 100 $\mu$m.

3. The composite material of claim 1 wherein the tungsten particles have a mean particle size of about 50 $\mu$m.

4. The composite material of claim 3 wherein the spheroidized tungsten particles have a particle size distribution having a standard deviation of no more than about 20 $\mu$m.

5. The composite material of claim 1 wherein the measured density is at least 99.5% of the theoretical density.

6. The composite material of claim 1 wherein the composite was formed by pressing a blend of spheroidized tungsten powder and tin powder at a pressure less than about 250 MPa.

7. The composite material of claim 1 wherein the composite contains 57 weight percent tungsten and 43 weight percent tin.

8. The composite material of claim 7 wherein the composite was formed by pressing a blend of spheroidized tungsten powder and tin powder at a pressure less than about 210 MPa.

9. The composite material of claim 1 wherein the composite deforms substantially uniformly under a compressive force.

10. A tungsten-tin composite material for lead-free ammunition comprising spheroidized tungsten particles imbedded in a tin matrix, the composite material having a measured density which is at least 99% of the theoretical density of the composite and deforming substantially uniformly under a compressive force, the tungsten particles having a mean particle size of less than 100 $\mu$m and a particle size distribution having a standard deviation of no more than about 20 $\mu$m.

11. The tungsten-tin composite of claim 10 wherein the composite was formed by pressing a blend of spheroidized tungsten powder and tin powder at a pressure less than about 250 MPa.

12. The tungsten-tin composite of claim 11 wherein the composite contains 57 weight percent tungsten and 43 weight percent tin.

13. The tungsten-tin composite of claim 12 wherein the tungsten particles have a mean particle size of about 50 $\mu$m.

14. A method of making a tungsten-tin composite for lead-free ammunition comprising:

forming a blend of a spheroidized tungsten powder and a tin powder;

pressing the blend at a pressure less than about 250 MPa to form the composite, the composite having a measured density which is at least 99% of the theoretical density of the composite.

15. The method of claim 14 wherein the tungsten particles have a mean particle size of less than 100 $\mu$m.

16. The method of claim 15 wherein the composite has a measured density which is at least 99.5% of its theoretical density.

17. The method of claim 14 wherein the tungsten particles have a particle size distribution having a standard deviation of no more than about 20 $\mu$m.

18. The method of claim 14 wherein the blend has a ratio of 57 weight percent tungsten to 43 weight percent tin and is pressed at a pressure less than about 210 MPa.

19. The composite material of claim 5 wherein the tungsten particles have a mean particle size of less than 100 $\mu$m.

20. The composite material of claim 5 wherein the tungsten particles have a mean particle size of about 50 $\mu$m.

21. The composite material of claim 20 wherein the spheroidized tungsten particles have a particle size distribution having a standard deviation of no more than about 20 $\mu$m.

* * * * *